US009793655B2

(12) United States Patent
Little

(10) Patent No.: US 9,793,655 B2
(45) Date of Patent: Oct. 17, 2017

(54) ELECTRICAL CONNECTOR WITH EXPANDED HOUSING TO FORM MATING CAVITY WITH OFFSET EMI SPRINGS

(71) Applicant: FOXCONN INTERCONNECT TECHNOLOGY LIMITED, Grand Cayman (KY)

(72) Inventor: Terrance F. Little, Fullerton, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/252,826

(22) Filed: Aug. 31, 2016

(65) Prior Publication Data

US 2017/0062976 A1 Mar. 2, 2017

Related U.S. Application Data

(60) Provisional application No. 62/213,121, filed on Sep. 2, 2015.

(51) Int. Cl.

| | |
|---|---|
| ***H01R 13/6582*** | (2011.01) |
| ***H01R 24/60*** | (2011.01) |
| ***H01R 13/502*** | (2006.01) |
| ***H01R 12/72*** | (2011.01) |

(52) U.S. Cl.

CPC ..... *H01R 13/6582* (2013.01); *H01R 24/60* (2013.01); *H01R 12/724* (2013.01); *H01R 13/502* (2013.01)

(58) Field of Classification Search

CPC ..... H01R 12/724; H01R 24/62; H01R 13/502

USPC ..... 439/607.17, 607.35, 607.4, 607.21, 660

See application file for complete search history.

(56) References Cited

U.S. PATENT DOCUMENTS

| | | | | |
|---|---|---|---|---|
| 6,165,015 | A * | 12/2000 | Wu | H01R 23/6873 439/567 |
| 7,641,519 | B1 * | 1/2010 | Chen | H01R 12/712 439/607.54 |
| 7,736,184 | B1 * | 6/2010 | Wan | H01R 13/648 439/607.11 |
| 7,806,735 | B1 * | 10/2010 | Chen | H01R 13/65802 439/676 |
| 7,862,346 | B1 * | 1/2011 | Wan | H01R 12/712 439/607.04 |
| 7,972,151 | B2 * | 7/2011 | He | H01R 13/6471 439/108 |

(Continued)

*Primary Examiner* — James Harvey
*Assistant Examiner* — Oscar C Jimenez
(74) *Attorney, Agent, or Firm* — Wei Te Chung; Ming Chieh Chang

(57) ABSTRACT

An electrical connector includes an insulative housing having a mating tongue and a supporting tongue both extending forwardly in a front-to-back direction and spaced from each other in a vertical direction perpendicular to said front-to-back direction. A plurality of contacts is disposed in the housing with corresponding contacting sections exposed upon the mating tongue and corresponding tails retained in the housing. A metallic shield encloses the housing and cooperates with the supporting tongue to commonly define a mating cavity in which the mating tongue extends forwardly. The supporting tongue includes a plurality of cutouts in which a plurality of offset spring tangs of the metallic shield extend with corresponding ends extending into the mating cavity.

18 Claims, 11 Drawing Sheets

(56) References Cited

U.S. PATENT DOCUMENTS

| | | | | |
|---|---|---|---|---|
| 8,206,174 | B2 * | 6/2012 | Ko | H01R 13/703 439/489 |
| 8,366,486 | B1 * | 2/2013 | Lan | H01R 13/6582 439/607.35 |
| 8,439,691 | B1 * | 5/2013 | Lan | H01R 12/724 439/660 |
| 8,545,273 | B1 * | 10/2013 | Chen | H01R 13/6658 439/660 |
| 8,602,825 | B2 * | 12/2013 | Chen | H01R 13/6658 439/660 |
| 9,325,123 | B2 * | 4/2016 | Yu | H01R 13/641 |
| 9,356,404 | B2 * | 5/2016 | Yu | H01R 13/6582 |
| 2010/0322566 | A1 * | 12/2010 | Zheng | G02B 6/32 385/74 |
| 2010/0322570 | A1 * | 12/2010 | Zheng | G02B 6/32 385/93 |
| 2013/0210251 | A1 * | 8/2013 | Little | H01R 13/7036 439/188 |
| 2013/0316592 | A1 * | 11/2013 | Yu | H01R 13/516 439/660 |
| 2014/0051274 | A1 * | 2/2014 | Yu | H01R 13/7031 439/188 |
| 2014/0051302 | A1 * | 2/2014 | Yu | H01R 13/641 439/660 |
| 2014/0220796 | A1 * | 8/2014 | Chang | H01R 29/00 439/64 |
| 2015/0333447 | A1 * | 11/2015 | Bai | H01R 13/64 439/607.54 |
| 2017/0077651 | A1 * | 3/2017 | Chang | H01R 13/6594 |

* cited by examiner

ELECTRICAL CONNECTOR WITH EXPANDED HOUSING TO FORM MATING CAVITY WITH OFFSET EMI SPRINGS

This application claims the benefit of, and priority to U.S. Provisional Patent Application No. 62/213,121, filed Sep. 2, 2015, the contents of which are incorporated entirely herein by reference.

BACKGROUND OF THE INVENTION

1. Field of the Invention

The present invention relates generally to an electrical connector, and more particularly to an electrical connector with the expanded housing for forming the mating cavity which is formed by the metallic shield traditionally.

2. Description of Related Arts

The traditional electrical USB (Universal Serial Bus) connector type A is popularly used in the computer field, and is essentially composed of an insulative housing formed with a forwardly extending mating tongue and enclosed within a metallic shield which forms a mating cavity in which the mating tongue extends for receiving a plug therein. On the other hand, in some dual-port stacked connector assembly, a partition formed by the housing is located between the upper port and the lower port and a metallic clip attached upon the partition with corresponding spring tangs respectively extending into the corresponding ports for mechanically and electrically connecting to the inserted plugs, respectively. Understandably, the mating cavity formed by the housing rather than the metallic shield, may be superior for manual operation.

A new single port USB connector with the mating cavity formed partially by the insulative housing instead of wholly by the metallic shield, is desired.

SUMMARY OF THE INVENTION

Accordingly, an object of the present invention is to provide an electrical connector having an insulative housing enclosed within a metallic shield wherein the mating cavity is formed by the insulative housing instead of the metallic shield while allowing the spring tang of the metallic shield to extend through the housing into the mating cavity for engagement with the plug inserted in the mating cavity.

To achieve the above object, an electrical connector for use with a complementary plug connector includes an insulative housing including a mating tongue and a supporting tongue both extending forwardly in a front-to-back direction and spaced from each other in a vertical direction perpendicular to said front-to-back direction, a plurality of contacts disposed in the housing with corresponding contacting sections exposed upon the mating tongue and tails section regulated by the housing, a metallic shield enclosing said housing and cooperating with the supporting tongue to commonly circumferentially define a mating cavity, for compliance with a contour of the complementary plug connector, in which said mating tongue forwardly extends, and a downwardly deflectable spring leaf unitarily formed with and extending forwardly from a main portion of a bottom wall of the shield, and including a lower section unitarily extending forwardly from the main portion at a lower level, a pair of middle sections laterally extending from two opposite lateral sides of the lower section at a middle level, and a pair of upper sections rearwardly extending from the pair of middle sections at an upper level. The lower sections are downwardly moveable above an undersurface of the bottom wall of the shield during mating with said complementary plug connector.

DETAILED DESCRIPTION OF THE PREFERRED EMBODIMENT

Figure 1:
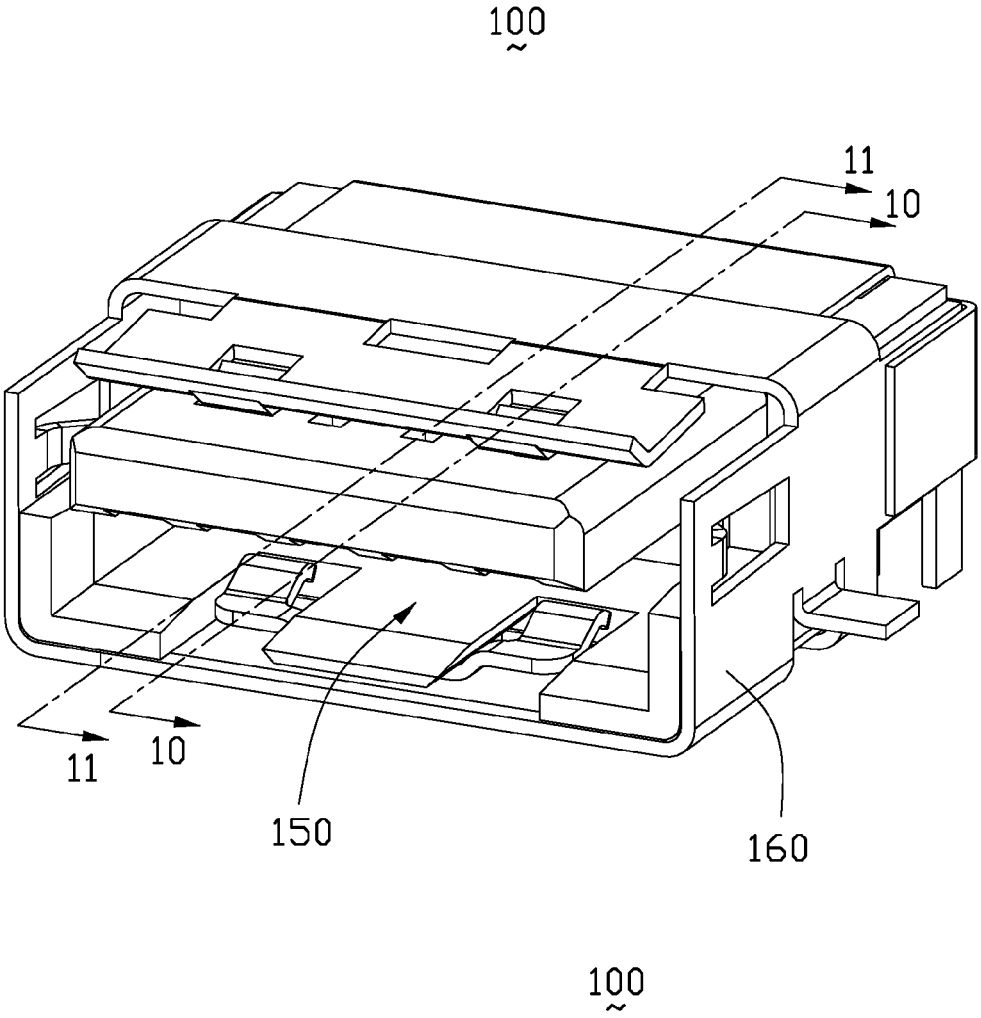
FIG. 1 is a front assembled perspective view of a preferred embodiment of an electrical connector according o the invention.
Figure 2:
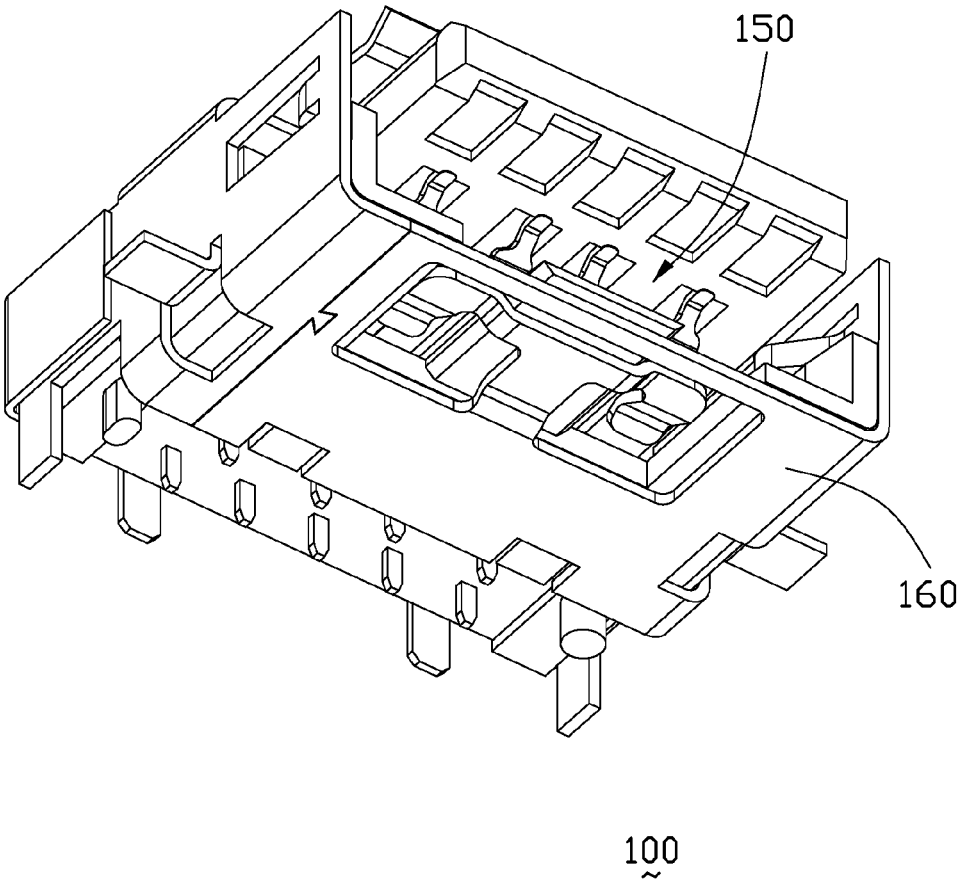
FIG. 2 is a rear assembled perspective view of the electrical connector of FIG. 1.
Figure 3:
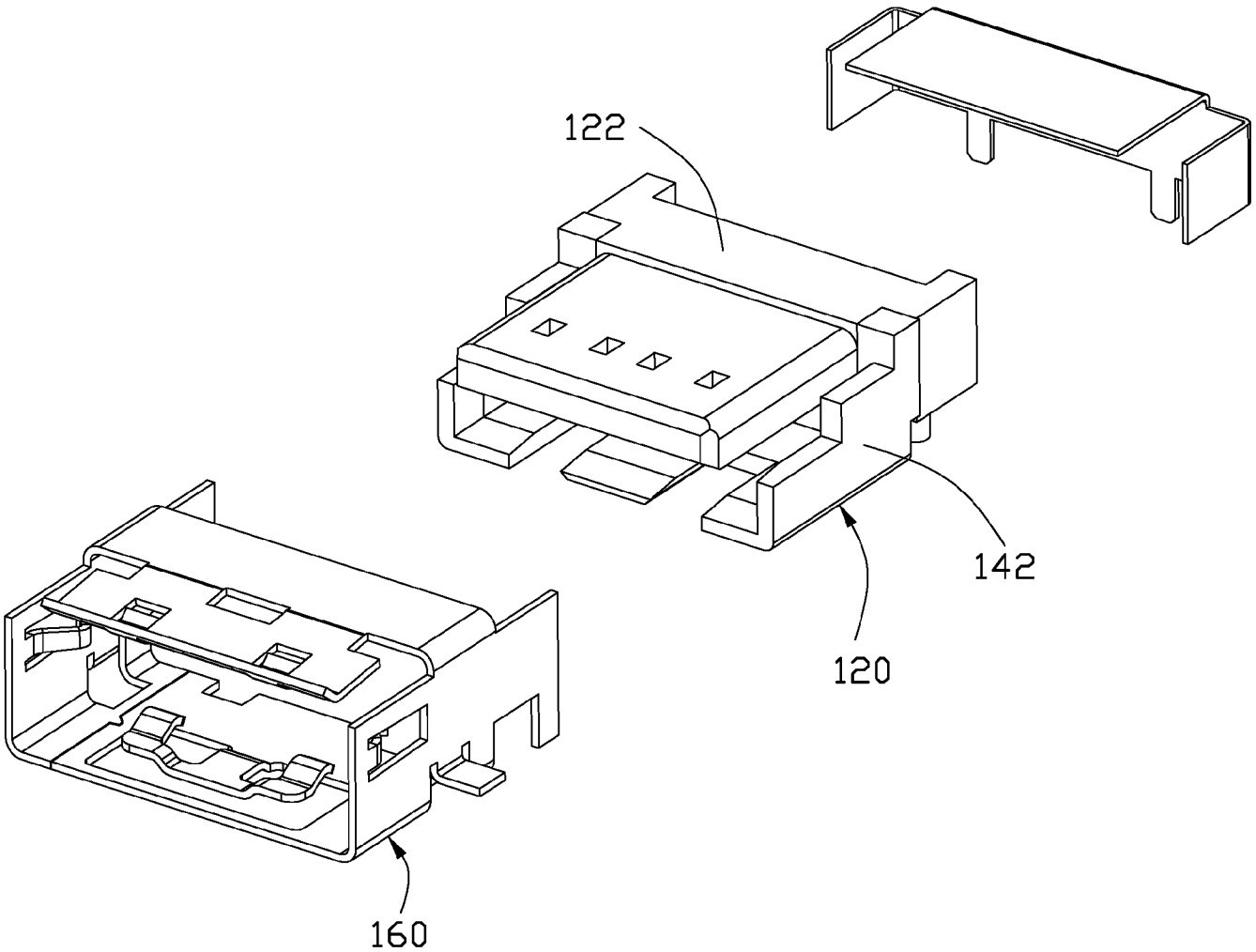
FIG. 3 is a front exploded perspective view of the electrical connector of FIG. 1.
Figure 4:
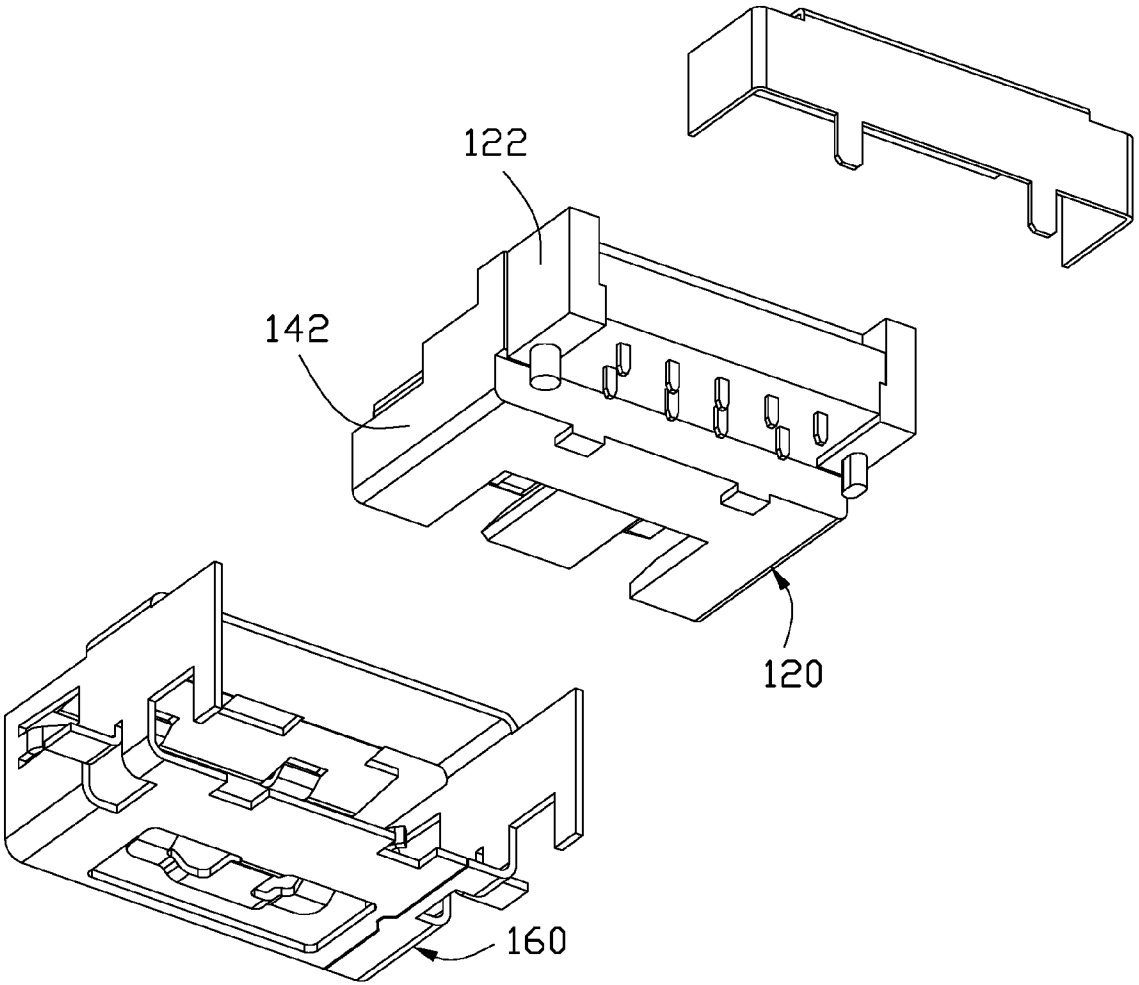
FIG. 4 is another front exploded perspective view of the electrical connector

Reference will now be made in detail to the preferred embodiment of the present invention.

Referring to FIGS. 1-11, the electrical connector 100 for mounting to a printed circuit board (not shown), having a USB 3.0 Type A interface, includes an insulative housing 120 enclosed in a metallic shield 150. The housing 120 is composed of a base 122 and a spacer 142 discrete from while assembled to each other in a vertical direction. The base 122 includes a main body 124 and a mating tongue 126 extending forwardly from the main body 124; similarly, the spacer 142 includes an organizer 144 and a supporting tongue 146 extending forwardly from the organizer 144. A metallic shield 160 encloses the housing 120 and cooperates with the supporting tongue 146 to commonly form a mating cavity 150 in which the mating tongue 126 forwardly extends and the complementary plug connector (not shown) is inserted.

A plurality of first passageways 128 are formed in the base 122. A plurality of first/resilient contacts 130 are received within the corresponding first passageways 128, respectively. A front contacting section 132 of the first contact 130 extends into the mating cavity 150 and a rear tail section 134 of the first contact 130 extending downwardly through a corresponding through hole 148 of the organizer 144 in a retentive manner. A plurality of second contacts 131 are embedded within the base 122 of the housing 120 via an insert-molding process with corresponding front contacting section 133 exposed to the mating cavity 150 and rear tail sections 135 extending downwardly through the corresponding through holes 149 in a retentive manner. As the regular USB 3.0 Type A connector, the first contact 130 is deflectable while the second contact 131 is stationary.

It is noted that the base 122 forms a pair of side recesses 129 and the spacer 142 forms a pair of lateral protrusions 149 for engagement within the corresponding recesses 129 so as to assemble the base 122 and the spacer 142 together. The base 122 further includes a pair of mounting posts 127 for mounting to the printed circuit board.

Figure 5:
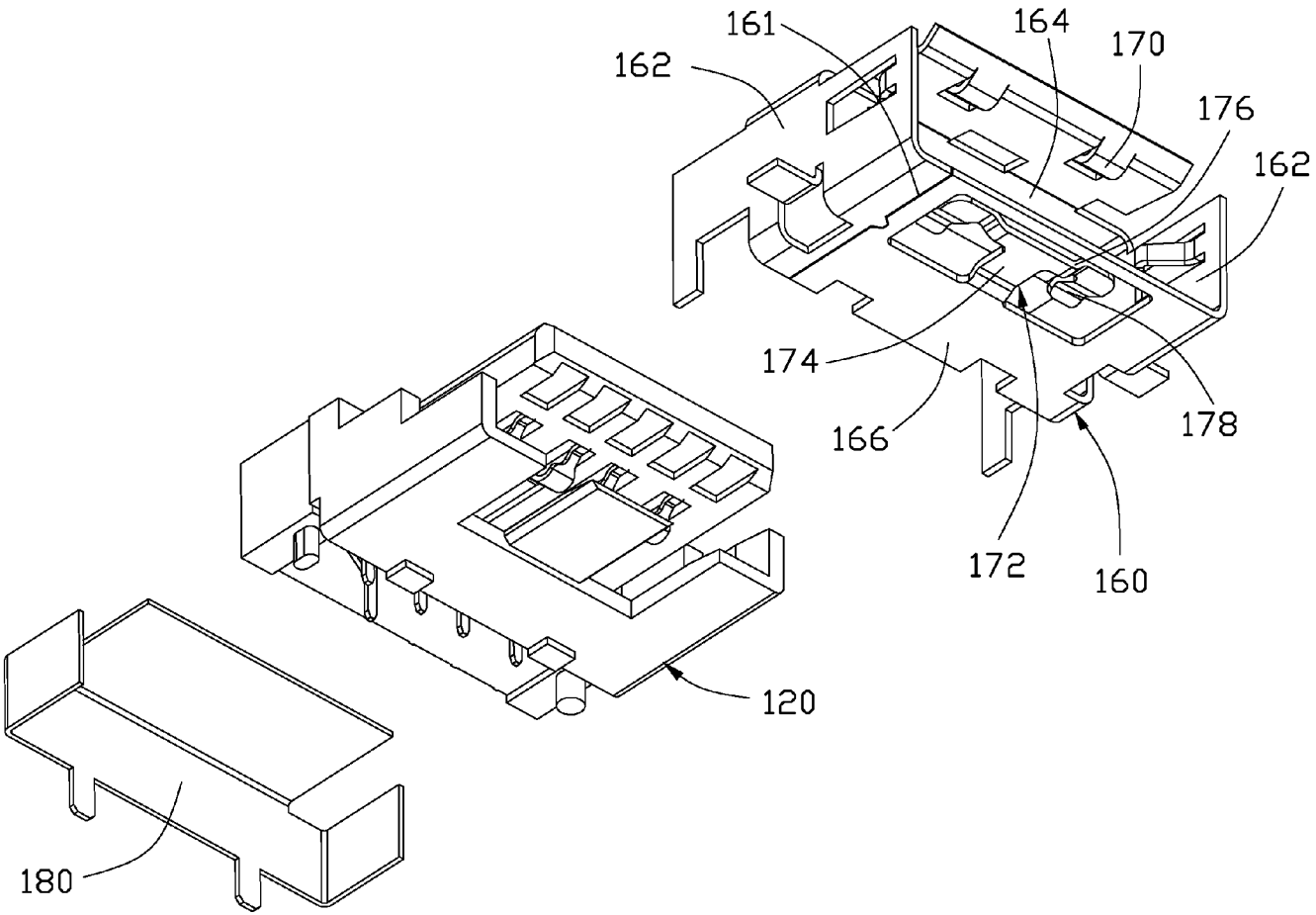
FIG. 5 is a rear exploded perspective view of the electrical connector of FIG. 1.
Figure 6:
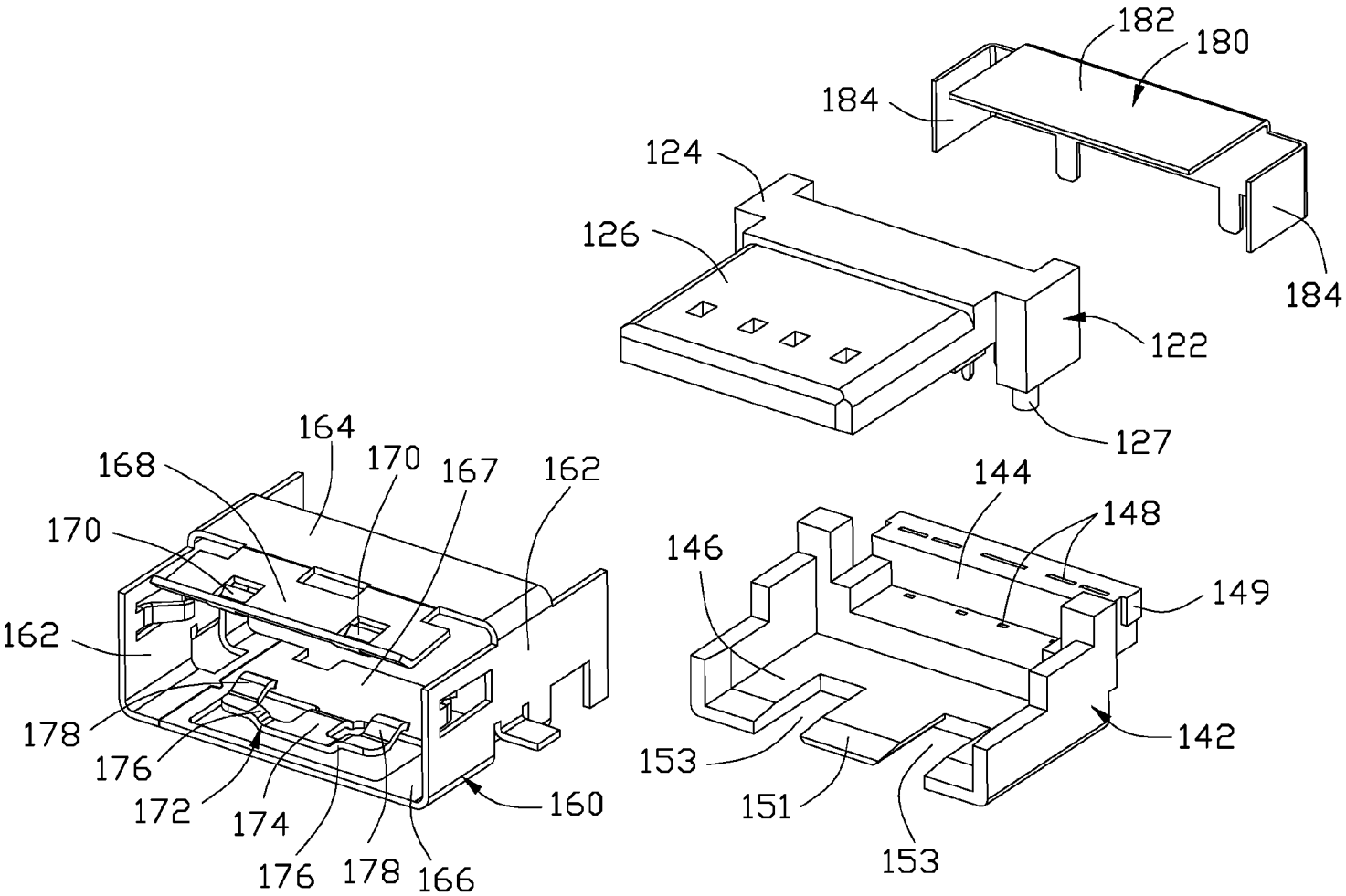
FIG. 6 is a further front exploded perspective view of the electrical connector of FIG. 3.
Figure 7:
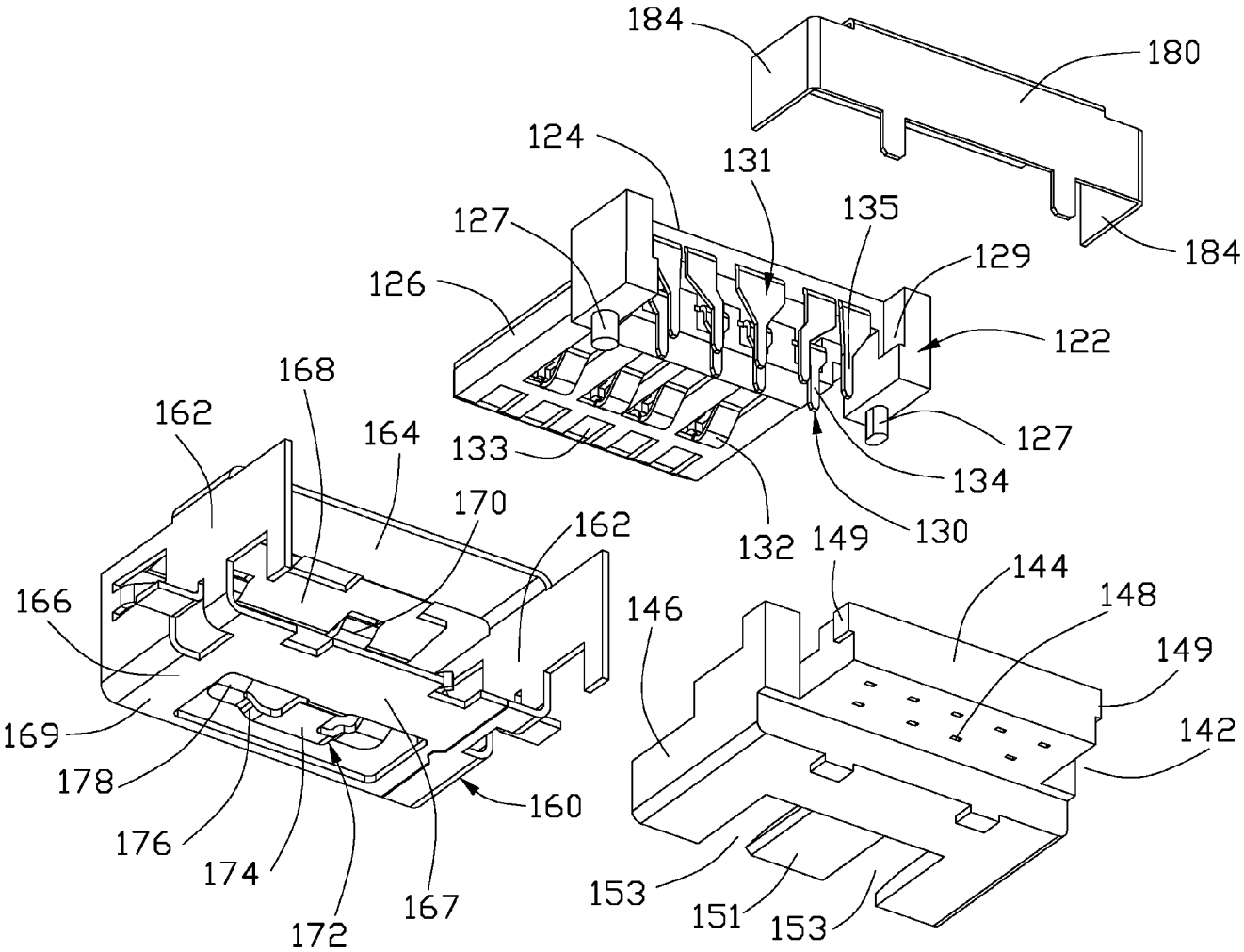
FIG. 7 is a further rear exploded perspective view of the electrical connector of FIG. 5.
Figure 8:
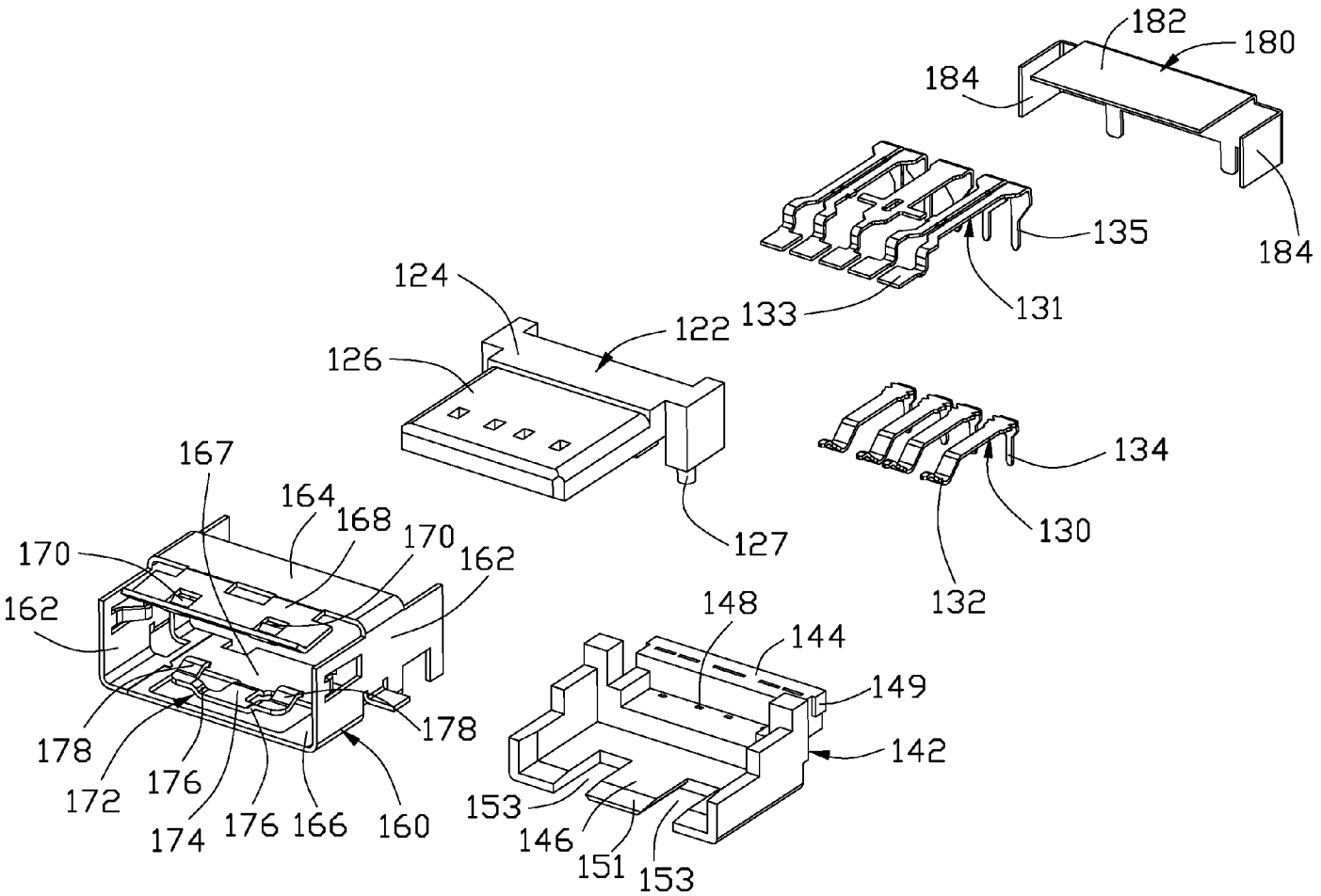
FIG. 8 is a further front exploded perspective view of the electrical connector of FIG. 6.
Figure 9:
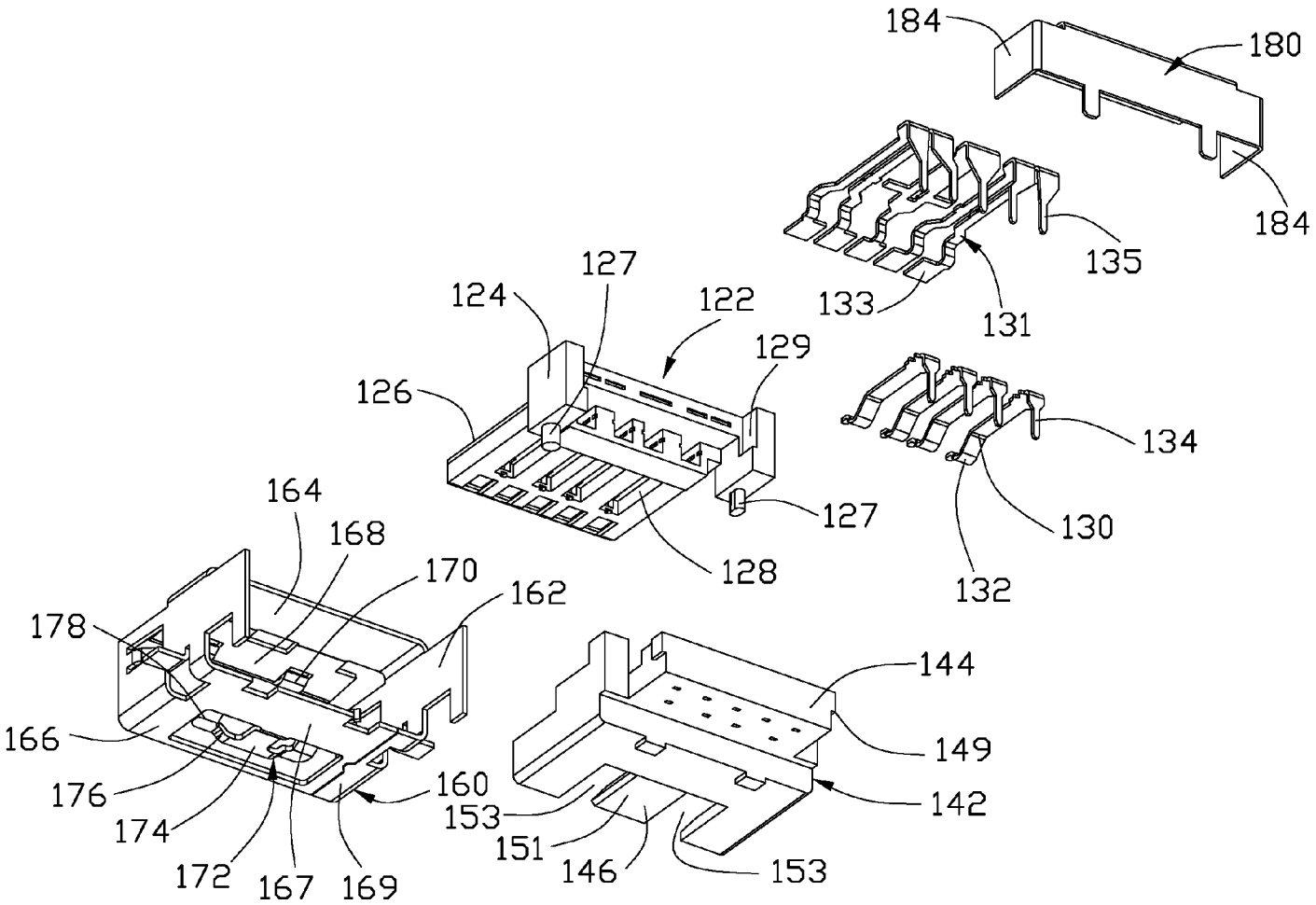
FIG. 9 is a further rear exploded perspective view of the electrical connector of FIG. 7.
Figure 10:
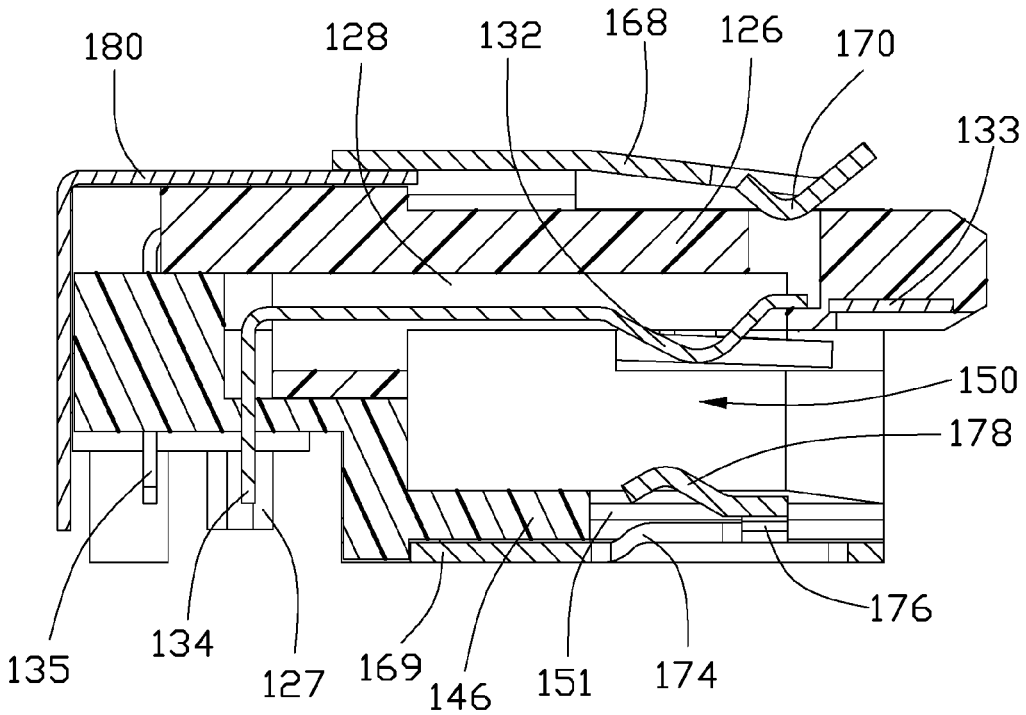
FIG. 10 is a cross-sectional view of the electrical connector of FIG. 1.
Figure 11:
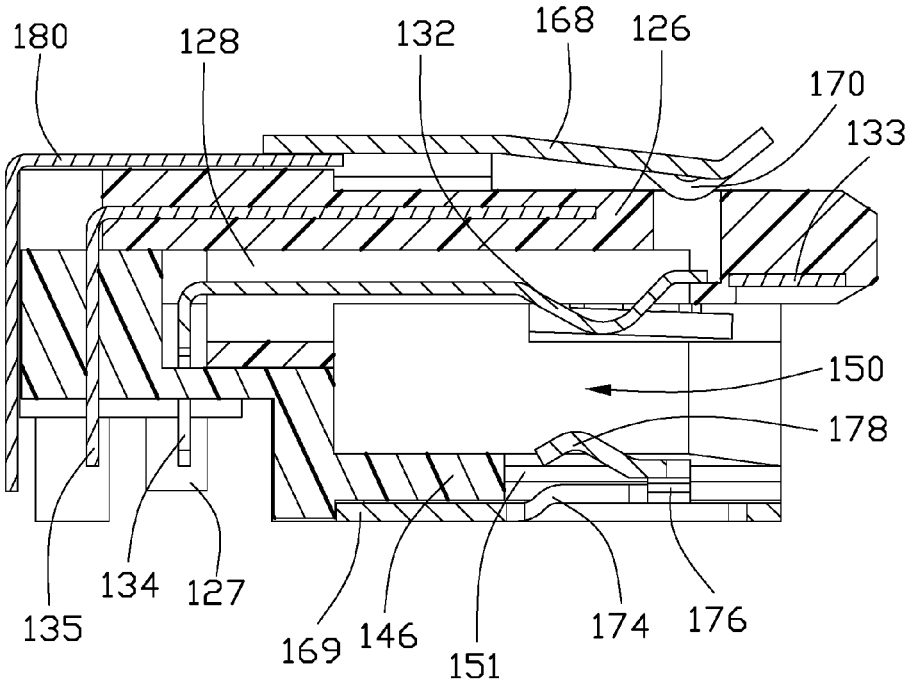
FIG. 11 is another cross-sectional view of the electrical connector of FIG. 1.

The shield 160 may be made via sheet metal with a seam shown with the dashed line 161 only in FIG. 5 for illustration only while lacking in other figures, and includes two opposite side walls 162 and opposite top wall 164 and bottom wall 166. The top wall 164 further includes a forward deflectable leaf 168 with a pair of rearward downward spring tabs 170 which stamped from/within the deflectable leaf 168 and downwardly extend into the mating cavity 150. The bottom wall 166 further includes another spring leaf 172 which is essentially composed of a lower section 174 extending forwardly from a main portion 167 of the bottom wall 166, a pair of middle sections 176 laterally extending respectively from two opposite lateral sides of the lower section 174, and a pair of upper sections 178 extending rearwardly from two opposite ends of the pair of middle sections 176, respectively, and upwardly into the mating cavity 150.

Notably, to comply with the structure of the spring leaf 172, the supporting tongue 146 forms a thinner central region 151 so as to intimately receive the lower section 174 thereunder, and a pair of cutouts 153 to receive the pair of upper sections 178, respectively. Understandably, via this three-segment or offset structure of the spring leaf 172, the downward deflection of the upper sections 178 due to insertion of the complementary plug connector, will result in no significant downward movement of the lower section 174, during mating with the complementary plug connector, which is desired to be above the undersurface 169 of the bottom wall 166, thus assuring no interference occurs between the lower section 174 of the spring leaf 172 and the environmental parts in the computer enclosure.

A rear metallic shell 180 is located upon a rear side of the housing 120, including a top plate 182 under the top wall 164 and sandwiched between the top wall 164 and the base 122 of the housing 120, and a pair of side plates 184 applied upon exterior surfaces of the corresponding side walls 162, respectively. Clearly, in this embodiment, the electrical connector 100 is mounted to the printed circuit board in a sink type so as to have a pair of mounting pads (not labeled) extending laterally and outwardly on two lateral sides of the metallic shield 160 at a level above the undersurface 169 with a distance. It is also noted that the mating cavity 150 for use with the plug connector, is defined and regulated inside of the supporting tongue 146 in the instant invention so as to be a hybrid type involved with both the metallic shield 160 and the supporting tongue 146 of the housing 120. Differently, in the traditional USB Type A, the mating cavity is merely/purely circumferentially defined/form by the metallic shield. In brief, in the traditional USB Type A connector, the receiving space defined by the metallic shield is essentially the mating cavity in compliance with a contour of the complementary connector while in the instant invention, such a receiving space is dimension to include both the so-called mating cavity 150 in compliance with the inserted complementary plug connector and an additional space accommodating therein the supporting tongue 146 wherein the receiving space solely defined by the metallic shield 160 is larger than the mating cavity defined by both the metallic shield 160 and the supporting tongue 146 in both vertical and lateral directions. It is also noted that the two opposite side walls 162 are also equipped with the corresponding EMI spring tabs/tangs which is also required to extend inwardly and laterally with a sufficient length/distance over the corresponding side extended structure (not labeled) of the supporting tongue 146 to reach the mating cavity 150. In other words, in the embodiment the supporting tongue 146 is further equipped with a pair of side plates (not labeled) to laterally restrict the mating cavity 150. Therefore, except the spring tabs 170, both the spring leaf 172 and the EMI spring tabs/tangs on the side walls 162 are required to extend further over the corresponding structure of the supporting tongue 146 to reach the mating cavity 150 compared with the traditional type connector where no supporting tongue is provided in the receiving space of the metallic shield.

While a preferred embodiment in accordance with the present invention has been shown and described, equivalent modifications and changes known to persons skilled in the art according to the spirit of the present invention are considered within the scope of the present invention as described in the appended claims. Notably, the features of the instant invention may include the structure of the spring leaf 172 and the corresponding structure of the supporting tongue 146 of the spacer 142, thus assuring a restrained deflection of the spring leaf 172 during mating with the inserted complementary plug connector.

What is claimed is:

1. An electrical connector for use with a complementary plug connector, comprising:

an insulative housing including a mating tongue and a supporting tongue both extending forwardly in a front-to-back direction and spaced from each other in a vertical direction perpendicular to said front-to-back direction;

a plurality of contacts disposed in the housing with corresponding contacting sections exposed upon the mating tongue and tail sections regulated by the housing;

a metallic shield enclosing said housing and cooperating with the supporting tongue to commonly circumferentially define a mating cavity, for compliance with a contour of the complementary plug connector, in which said mating tongue forwardly extends; and a downwardly deflectable spring leaf unitarily formed with and extending forwardly from a main portion of a bottom wall of the shield, and including a lower section unitarily extending forwardly from the main portion at a lower level, a pair of middle sections laterally extending from two opposite lateral sides of the lower section at a middle level, and a pair of upper sections rearwardly extending from the pair of middle sections at an upper level; wherein the lower section is downwardly moveable above an undersurface of the bottom wall of the shield during mating with said complementary plug connector.

2. The electrical connector as claimed in claim 1, further including another forwardly extending and upwardly deflectable spring leaf with a pair of rearwardly extending and upwardly deflectable spring tabs invading the mating cavity.

3. The electrical connector as claimed in claim 1, wherein the supporting tongue forms a thinner central region to intimately receive the lower section of the spring leaf thereunder, and a pair of cutouts to receive the pair of upper sections therein so as to allow said pair of upper sections to extend upwardly into the mating cavity.

4. The electrical connector as claimed in claim 3, wherein the spring leaf is located above the undersurface of the bottom wall of the shield.

5. The electrical connector as claimed in claim 1, wherein the metallic shield has opposite side walls and opposite top and bottom walls to commonly define a receiving space accommodating both the supporting tongue and the mating cavity therein.

6. The electrical connector as claimed in claim 5, wherein a rear metallic shell is located upon a rear side of the housing, including a top plate under the top wall and sandwiched between the top wall and the housing, and a pair of side plates applied upon exterior surfaces of the corresponding side walls respectively.

7. The electrical connector as claimed in claim 1, wherein the housing includes a base and a spacer discrete from while assembled to each other along a vertical direction, the base has a main body, and the mating tongue extends forwardly from the main body in a front-to-back direction perpendicular to the vertical direction, the spacer has a tail organizer and the supporting tongue extends forwardly from the tail organizer in the front-to-back direction, the tails section regulated by the tail organizer.

8. The electrical connector as claimed in claim 7, wherein the base forms a pair of side recesses and the spacer forms a pair of lateral protrusions for engagement within the corresponding recesses so as to assemble the base and the spacer together.

9. An electrical connector for use with a complementary plug connector, comprising:

an insulative housing having a mating tongue and a supporting tongue both extending forwardly in a front-to-back direction and spaced from each other in a vertical direction perpendicular to said front-to-back direction;

a metallic shield enclosing said housing and defining a receiving space to accommodate not only a mating cavity for compliance with a contour of the complementary plug connector but also the supporting tongue which is intimately located by the mating cavity in the vertical direction; and a forwardly extending three-segment spring leaf unitarily extending from the shield and including a forwardly extending lower section intimately located on an undersurface of an thinner central region of the supporting tongue at a lower level, a middle section extending laterally from the lower section at a middle level, and an upper section extending rearwardly from the middle section;

wherein the supporting tongue includes a cutout to allow said upper section to extend upwardly into the mating cavity.

10. The electrical connector as claimed in claim 9, further including another forwardly extending and upwardly deflectable spring leaf with a pair of rearwardly extending and upwardly deflectable spring tabs invading the mating cavity.

11. The electrical connector as claimed in claim 9, wherein the spring leaf is located above an undersurface of a bottom wall of the shield.

12. The electrical connector as claimed in claim 9, wherein the housing includes a base and a spacer discrete from while assembled to each other along a vertical direction; the base has a main body, and the mating tongue extends forwardly from the main body in a front-to-back direction perpendicular to the vertical direction and defines a plurality of contacts therein; the spacer has a tail organizer and the supporting tongue extends forwardly from the tail organizer in the front-to-back direction.

13. An electrical connector for mating with a plug, comprising:

an insulative housing including a mating tongue and a supporting tongue both extending along a front-to-back direction in a parallel manner while spaced from each other in a vertical direction perpendicular to said front-to-back direction, said supporting tongue defining opposite first and second faces in the vertical direction wherein said first face faces toward the mating tongue;

a plurality of contacts disposed in the housing with contacting sections exposed upon the mating tongue;

a metallic shield enclosing both said mating tongue and said supporting tongue and including opposite first and second spring leafs in the vertical direction, said first spring leaf being spaced from the mating tongue in the vertical direction while the second spring leaf having a root region upon the second face, a plug receiving cavity defined by the first spring leaf and said first face of the supporting tongue; wherein a free region of the second spring leaf is deflectable in said vertical direction with a range which extends beyond the first face for engagement with the plug while not beyond the second face for no interference with an exterior component located adjacent to the second face in the vertical direction.

14. The electrical connector as claimed in claim 13, wherein said second spring leaf includes a first section and second section offset from each other in the vertical direction, said second section being closer to the second face than said first section, said first section extending into the plug receiving cavity while said second section not.

15. The electrical connector as claimed in claim 14, wherein said second section unitarily extends forwardly from the root region while said first section unitarily extends rearwardly from the second section.

16. The electrical connector as claimed in claim 14, wherein said housing includes a base and a spacer assembled to each other, said mating tongue formed on the housing while said supporting tongue formed on the spacer.

17. The electrical connector as claimed in claim 16, wherein said base and said spacer are assembled to each other in the vertical direction.

18. The electrical connector as claimed in claim 16, wherein said spacer regulates tails of the contacts in the vertical direction.

* * * * *